US005522371A

United States Patent [19]

Kawamura

[11] Patent Number: 5,522,371

[45] Date of Patent: Jun. 4, 1996

[54] THERMAL INSULATION ENGINE

[75] Inventor: Hideo Kawamura, Kanagawa, Japan

[73] Assignee: Isuzu Ceramics Research Institute Co., Ltd., Kanagawa, Japan

[21] Appl. No.: 329,652

[22] Filed: Oct. 25, 1994

[30] Foreign Application Priority Data

Oct. 26, 1993 [JP] Japan ..... 5-288628

[51] Int. Cl.[6] ..... F02F 1/24

[52] U.S. Cl. ..... 123/668

[58] Field of Search ..... 123/668, 669, 123/193.5, 193.3

[56] References Cited

U.S. PATENT DOCUMENTS

| | | | |
|---|---|---|---|
| 3,996,913 | 12/1976 | Hamparian | 123/668 |
| 4,202,310 | 5/1980 | Zorilla et al. | 123/668 |
| 4,562,799 | 1/1986 | Woods et al. | 123/668 |
| 4,774,926 | 10/1988 | Adams | 123/668 |
| 4,796,572 | 1/1989 | Heydrich | 123/193.2 |
| 4,805,571 | 2/1989 | Humphrey | 123/668 |
| 5,033,427 | 7/1991 | Kawamura et al. | 123/668 |
| 5,054,443 | 10/1991 | Kawamura | 123/292 |

FOREIGN PATENT DOCUMENTS

| | | | |
|---|---|---|---|
| 0352058 | 1/1990 | European Pat. Off. | 123/668 |
| 3926796 | 2/1991 | Germany | 123/669 |
| 55-49553 | 4/1980 | Japan | 123/669 |
| 60-90955 | 5/1985 | Japan | 123/668 |

*Primary Examiner*—David A. Okonsky
*Attorney, Agent, or Firm*—Staas & Halsey

[57] ABSTRACT

The combustion chamber of an engine is formed in a double insulation structure where partially stabilized zirconia (PSZ) material having a low thermal conductivity is disposed between two walls for thermal installation. The double insulation structure has a head liner made of a silicon nitride material and an outer tubing which are separated by a space. A plurality of gaskets, i.e. the PSZ materials, are arranged in the space, with each having a PSZ thermal insulator 31 sandwiched between two contact claddings made of stainless steel or copper. The escape of heat from the head liner is minimized by the PSZ material, having a lower thermal conductivity, thereby increasing a thermal insulation quality of the combustion chamber.

8 Claims, 2 Drawing Sheets

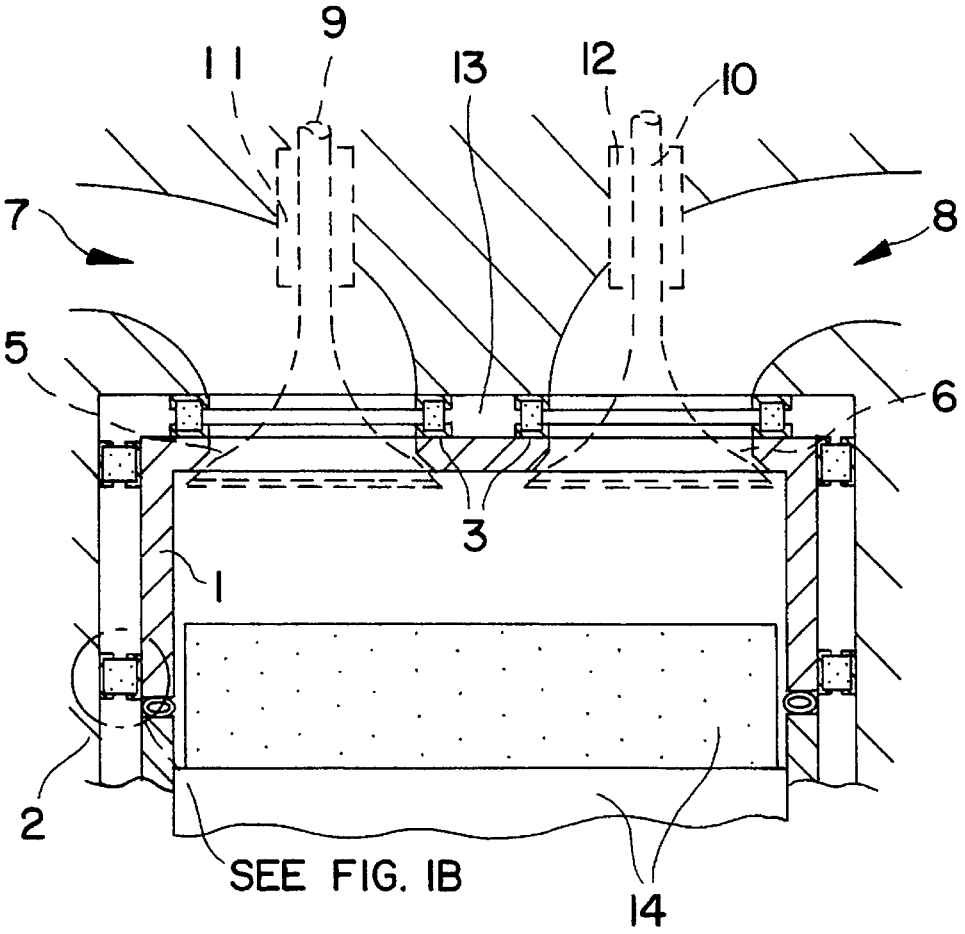
FIG. IA
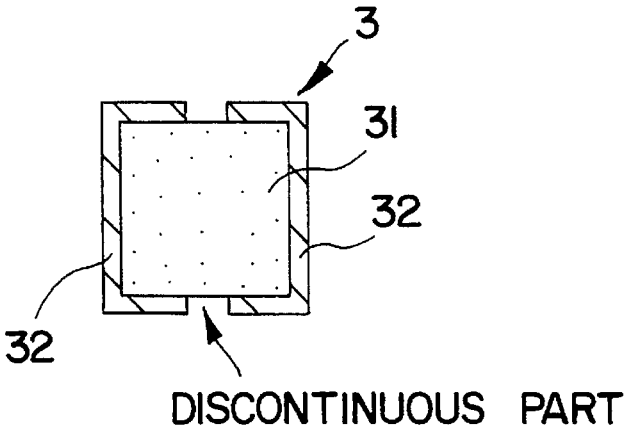
FIG. IB

THERMAL INSULATION ENGINE

BACKGROUND OF THE INVENTION

1. Field of the Invention

The present invention relates to a thermal insulation engine and particularly, a thermally insulated engine structure having a combustion chamber section made of a ceramic or equivalent composite material which has a higher resistance to heat and thereby increasing the thermal efficiency during operation at a high temperature without the need for an extra cooling service.

2. Description of the Prior Art

A variety of thermal insulation engines have been developed having cylinders and pistons in the combustion chamber section made of highly heat-resistant ceramic or other composite materials rather than conventional metals to provide a higher thermal insulation structure. The thermal efficiency during operation at high combustion temperatures will be increased without the use of any cooling system.

In general, the combustion chamber of such a thermal insulation engine has a ceramic inner wall covered at an outer side with a low thermal conductive material, thus comprising a composite construction. Accordingly, the thermal insulation engine can offer a higher thermal insulation effect with its structure. This type of thermal insulation engine includes a zirconia coated combustion chamber which is best known.

The engine of the foregoing type is however a heat regist type combustion engine. However the quantity of heat removed from the combustion gas to the combustion chamber is large. Therefore the escape of heat can hardly be prevented.

As the combustion chamber section of the engine is made of a highly heat resistant material, such as silicon nitride with its protective cladding of a low thermal conductive material, the radiation of heat is substantially reduced.

It is known that the transfer of heat mass Q across the wall of a combustion chamber is calculated from:

$$Q=As-Ki(Tg-Ta) \quad (1)$$

where As is the surface area of the combustion chamber, Ki (i=1 or 2) is the thermal transmittance, Tg is the temperature of gas, and Ta is the temperature of air or water.

If K1 is a thermal transmittance of the combustion chamber, and the combustion chamber consists of a composite material made of a stainless steel coated with a zirconia ceramicmaterial, the equation for Ki is expressed as:

$$K1=1/(1/ag+d1/kpz+d2/kst+1/ac) \quad (2)$$

It is now assumed that ag is a coefficient of heat transfer determined by the state of the gas in the cylinder and commonly, 250 kcal/(m °C. h), ac is a coefficient of heat transfer from cooling water to cylinder body and commonly, 5000 kcal/(m °C. h), kpz is a thermal conductivity of zirconia as 5 kcal/(m °C. h), and kst is a thermal conductivity of stainless steel as 40 kcal/(m °C. h). When those values are substituted for the terms in the equation (2), K1 is as high as approximately 200 kcal/(m °C. h).

If the construction is shifted to a double insulation structure which comprises a by heat-proof combustion chamber surrounded by air gaps, its thermal transmittance K2 is expressed as:

$$K2=1/(1/ag+d1/kpz+d2/ksn+d3/kst+1/ac) \quad (3)$$

As indicated above, ag is a coefficient of heat transfer determined by the state of the gas in the cylinder and commonly, 250 kcal/(m °C. h), ac is a coefficient of heat transfer from cooling water to cylinder body and commonly, 5000 kcal/(m °C. h), kpz is a thermal conductivity of zirconia as 5 kcal/(m °C. h), and kst is a thermal conductivity of stainless steel as 40 kcal/(m °C. h). Therefore, K2 is approximately 88 kcak/(m °C. h) as calculated from the equation (3).

As apparent, the thermal transmittance of the conventional thermal insulation engine equipped with the zirconia coated combustion chamber remains high and will hardly increase the thermal efficiency of the engine.

SUMMARY OF THE INVENTION

It is an object of the present invention, for solving the foregoing drawback, to provide a thermal insulation engine arranged to be higher in thermal efficiency by preventing thermal energy from escaping from its combustion chamber as much as possible.

It is another object of the present invention to provide a thermal insulation engine having its combustion chamber constructed in a double insulation structure for minimizing the escape of heat.

For achievement of the foregoing objects of the present invention, a thermal insulation engine having the inner wall of a combustion chamber surrounded by a cylinder, a cylinder head, a piston etc. made of a heat-resistant ceramic material for running at a higher temperature, comprises a head liner made of a heat-resistant material and consisting mainly of a cylinder head and a liner in a combination, and gaskets made of a low thermal conductive material and disposed in a space between the head liner and an outer tubing to allow the head liner to communicate with the outer tubing by less than 20% of its outer surface area.

Accordingly, the combustion chamber of the thermal insulation engine has a double insulation structure comprising the silicon nitride head liner and the outer tubing which are separated by a space. In addition, the PSZ gaskets having a low thermal conductivity are disposed in the space. As a result, the escape of heat from the high-temperature head liner will be minimized, thus increasing a thermal insulation quality of the combustion chamber.

BRIEF DESCRIPTION OF THE DRAWINGS

FIG. 1 is a partial cross sectional view of the combustion chamber of a thermal insulation engine showing one embodiment of the present invention;

DESCRIPTION OF THE PREFERRED EMBODIMENTS

Figure 2:
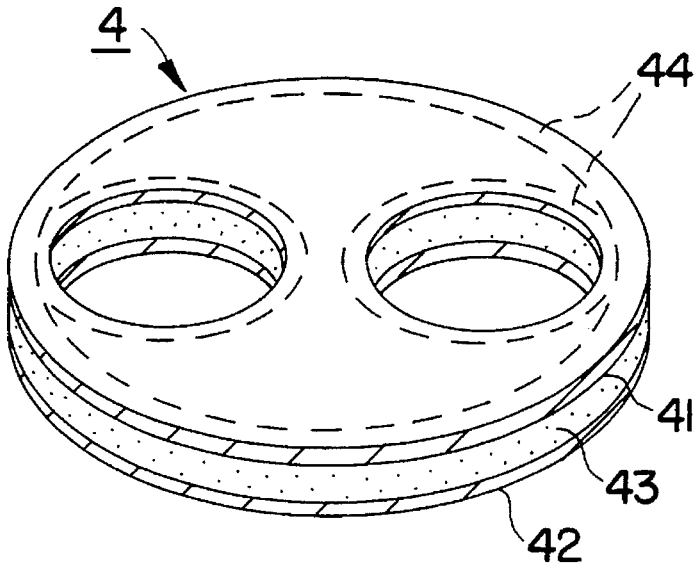
FIG. 2 is a perspective view showing another embodiment of the present invention.

Preferred embodiments of the present invention will be described in more with reference to the accompanying drawings.

FIG. 1 is a partial cross sectional view of the combustion chamber of a thermal insulation engine showing a first embodiment of the present invention.

As shown, a head liner 1 of a cylinder in the combustion chamber comprises a combination of a cylinder head and a liner made of a silicon nitride material which has a high resistance to heat of as high as 1100° C., a specific heat equivalent to that of steel, and a specific gravity of 1/2.5 compared with that of steel. This allows the thermal response at the wall of the combustion chamber to be high and more specifically, the transfer of heat from the high-temperature combustion gas to be enhanced. The heat transfer from the wall or head liner to the gas is relatively small during the intake and compression strokes, and the heat transfer from the gas to the head liner is large during the combustion.

An outer tubing 2 of the cylinder is made of e.g. cast iron and spaced by a given distance from the head liner 1.

A plurality of gaskets 3 are disposed between the head liner 1 and the outer tubing 2 so that the contact between the head liner 1 and the outer tubing g is made with leas than 20% of its entire extension for thermal insulation. The gasket 3 comprises a thermal insulator 31 made of partially stabilized zirconia (referred to as PSZ hereinafter) and two contact members 32 holding the thermal insulator 31 from both sides or more specifically, two, upper and lower, stream sides across a path of heat transfer.

The thermal conductivity of PSZ is as low as 1.6 kcal/(m °C. h). The thermal insulator 31 has a square shape in cross section sandwiched between the two contact members 32 which are made of soft stainless steel or copper and formed of a C-shape in cross section. The two contact members 32 are isolated from each other as staying at the heat incoming sides and the heat release sides respectively, preventing no direct transfer of heat along any metal.

As shown in FIG. 1, there is an intake port 5 and an exhaust port 6 provided above the head liner 1. The intake port 5 and the exhaust port 6 are communicated with an intake passage 7 and an exhaust passage 8, and respectively arranged in the outer tubing 2. Two valve guides 11 and 12 are disposed above the intake 7 and exhaust passages 8 for movably supporting an intake valve 9 and an exhaust valve 10, respectively. The two passages 7 and 8 are separated by their respective annular gaskets 13 from a space 13 defined by the head liner 1 and the outer tubing 2. Denoted by reference numeral 14 is a piston 14 in the combustion chamber.

The action of the first embodiment will now be explained. As the thermal conductivity of the head liner 1 (made of the silicon nitride material) is relatively small, the temperature on the cylinder wall increases rapidly upon starting the engine. An abrupt increase in the wall temperature will suppress the escape of thermal energy during the generation of heat.

In the space between the head liner 1 and the outer tubing 2, the gaskets 3 (composed mainly of the low thermally conductive PSZ) are arranged at equal intervals to directly engage with less than 20% of the inner side of the outer tubing 2. Also, the two contact members 32 of each gasket 3 are isolated from each other. Accordingly, the transfer of heat from the head liner 1 will be minimized.

Figure 3:
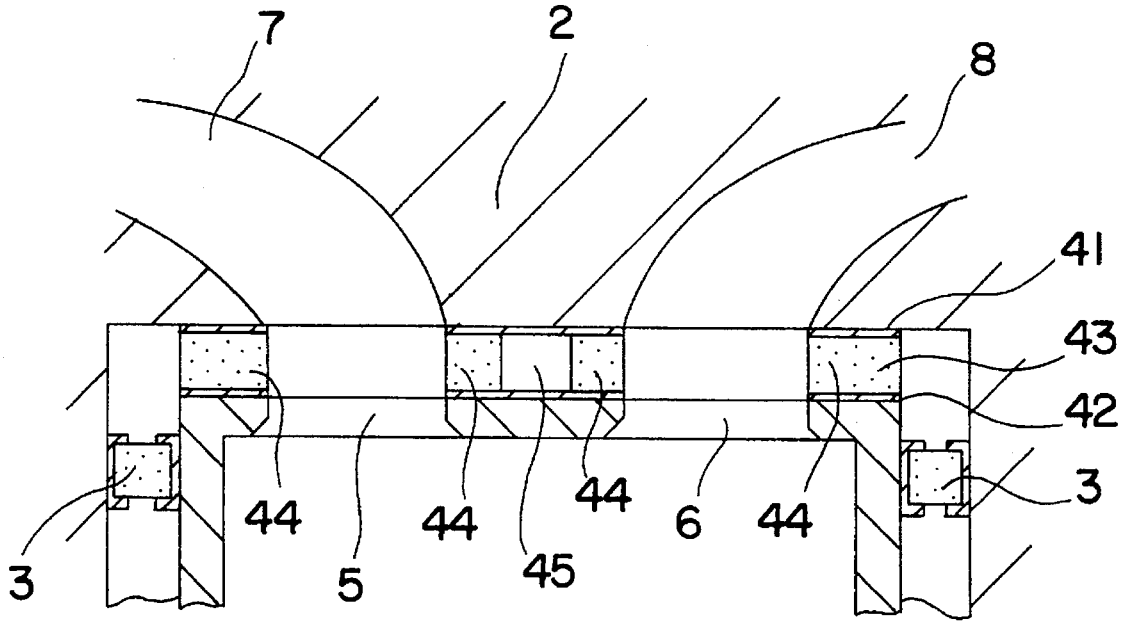
FIG. 3 is a cross sectional view of the same.

FIGS. 2 and 3 are a perspective view and a cross sectional view, respectively, of another thermal insulation arrangement of the cylinder head showing a second embodiment of the present invention. A thermal insulator disk 4 is disposed between the cylinder head and the upper end of the outer tubing. Disk 4 comprises an outside plate and an inside plate. 41 and 42, respectively, of stainless steel or copper. A thermal insulator material 43 of PSZ is sandwiched between the two plates 41 and 42. The thermal insulator material 43 is extended in a minimum sealing region 44, thus defining a space 45 (FIG. 3) filled with no PSZ.

In the above mentioned embodiment, plates 41 and 42 are made from copper or stainless steel, but outside plate 41 can be made from copper or stainless steel, and inside plate 42 can made from heat-resistance metals.

In action, the PSZ having a low thermal conductivity is disposed in the sealing region 44 between the cylinder head and the outer tubing of an engine. According to the second embodiment, as in the first embodiment, the escape of heat from the cylinder head will be minimized during the operation of the engine.

As set forth above, the combustion chamber of the thermal insulation engine of the present invention has a double insulation structure comprising the silicon nitride head liner and the outer tubing which are separated by a space. In addition, the PSZ gaskets having a low thermal conductivity are disposed in the space with their two opposite sides coated with a metal for direct contact with the walls of the cylinder liner and the outer tubing respectively. As a result, the transfer of heat from the high-temperature head liner to the outer tubing is minimized thus to increasing a thermal insulation quality of the combustion chamber.

With the thermal insulation structure of the first embodiment, the thermal transmittance is calculated to be as low as 68 kcal/(m °C. h) from the equation (3) which is much lower than that of the conventional thermal insulation engine.

The present invention is not limited to the above described embodiments but various changes and modifications will be possible without departing from the scope of the present invention.

What is claimed is:

1. A thermal insulation engine having an inner wall of a combustion chamber made of heat-resistant ceramic material for high temperature operation, comprising:

a head liner made of a heat-resistant material and consisting mainly of a cylinder head and a liner in a combination; and a plurality of gaskets each having a low thermal conductive material disposed between a pair of contact members, wherein each of said gaskets is disposed in a space between the head liner and an outer tubing to allow the head liner to communicate with the outer tubing by less than 20% of its outer surface area.

2. A thermal insulation engine according to claim 1, wherein said heat-resistant material of the head liner is silicon nitride.

3. A thermal insulation engine according to claim 1, wherein the low thermal conductive material of the gaskets is partially stabilized zirconia (PSZ).

4. A thermal insulation engine according to claim 1, wherein each of said gaskets has two soft metal claddings mounted to both sides thereof for direct contact with said head liner and the outer tubing respectively so that said two metal claddings are discontinuous in the direction of heat dissipation.

5. A thermal insulation engine according to claim 4, wherein said soft metal cladding is copper or stainless steel.

6. A thermal insulation engine according to claim 1, wherein one of said gaskets is disposed between an intake port and an exhaust port of the thermal insulation engine.

7. A thermal insulation engine for high temperature operation comprising:

an outer tubing having a cavity disposed therein;

a head liner having an intake passage and an exhaust passage, wherein the head liner is disposed within the tubing cavity and forms a space between an exterior surface of the head liner and an interior surface of the outer tubing; and a gasket having a thermal insulating layer, a first contact member disposed on a first side of the thermal layer, and a second contact member disposed on a second side of the thermal insulating layer, said gasket having an intake hole with a radial intake hole sealing region disposed there around, an exhaust hole with a radial exhaust hole sealing region disposed there around, and an outer periphery having a radial sealing region disposed there around;

wherein said thermal insulating layer is formed between the first and second contact layers within the radial intake hole sealing region, the radial exhaust hole sealing region and the outer periphery sealing region.

8. A thermal insulation engine for high temperature operation comprising:

an outer tubing having a cavity disposed therein;

a head liner having an intake passage and an exhaust passage, wherein the head liner is disposed within the tubing cavity and forms a space between an exterior surface of the head liner and an interior surface of the outer tubing; and a plurality of gaskets disposed between the outer tubing and the head liner in said space, each of said gaskets further comprising:

a thermal insulating layer; and a pair of contact members disposed on alternate sides of the thermal layer;

wherein a first contact member of said pair of contact members contacts the outer tubing and a second contact member of said pair of contact members contacts the head liner.

* * * * *

UNITED STATES PATENT AND TRADEMARK OFFICE

CERTIFICATE OF CORRECTION

PATENT NO. : 5,522,371

DATED : June 4, 1996

INVENTOR(S) : Hideo KAWAMURA

It is certified that error appears in the above-indentified patent and that said Letters Patent is hereby corrected as shown below:

Title Page, [30], Priority Data, delete "Oct. 26, 1993" and insert

--Oct. 25, 1993--.

Column 1, line 6, delete "1.";

line 15, delete "2.";

line 32, insert --,-- after "However";

lines 57, 59 and 60, delete "h)," and insert --h);--.

Column 2, lines 5 and 7, delete "h)," and insert --h);--.

Signed and Sealed this

Fifth Day of November, 1996

*Attest:*

Bruce Lehman

BRUCE LEHMAN

*Attesting Officer*

*Commissioner of Patents and Trademarks*